United States Patent [19]

Davis

[11] Patent Number: 4,660,027

[45] Date of Patent: Apr. 21, 1987

[54] REDUCED POWER CONSUMPTION LOW BATTERY ALERT DEVICE

[75] Inventor: Walter L. Davis, Plantation, Fla.

[73] Assignee: Motorola, Inc., Schaumburg, Ill.

[21] Appl. No.: 646,618

[22] Filed: Aug. 31, 1984

[51] Int. Cl.[4] ..... G08B 21/00

[52] U.S. Cl. ..... 340/636; 340/661; 340/691; 324/433; 324/435

[58] Field of Search ..... 340/636, 635, 660, 661, 340/691; 324/426, 436, 435, 433, 133; 320/48, 13; 429/92, 61

[56] References Cited

U.S. PATENT DOCUMENTS

| | | | |
|---|---|---|---|
| 3,475,061 | 10/1969 | Steinkamp et al. | 307/130 |
| 3,568,175 | 3/1971 | Schwehr | 320/48 X |
| 3,877,001 | 4/1975 | Bogut et al. | 340/249 |
| 3,932,797 | 1/1976 | York | 320/48 |
| 4,143,283 | 3/1979 | Graf et al. | 307/66 |
| 4,237,198 | 12/1980 | Eby et al. | 429/93 |
| 4,471,492 | 9/1984 | Mann et al. | 455/73 |
| 4,488,115 | 12/1984 | Podhrasky | 340/636 X |
| 4,535,325 | 8/1985 | Marsh | 324/436 X |
| 4,574,276 | 3/1986 | Sato | 340/661 |

*Primary Examiner*—James L. Rowland
*Assistant Examiner*—Jeffery A. Hofsass
*Attorney, Agent, or Firm*—Martin J. McKinley; Daniel K. Nichols; Joseph T. Downey

[57] ABSTRACT

A reduced power consumption low battery indicator comprising in the preferred embodiment a transducer driver which drives a transducer to provide an audible alert. A microprocessor is used to generate a square-wave signal to power the transducer driver whenever the battery is depleted to a first predetermined level. A first low battery sensor is used to determine when the battery is depleted to the first predetermined level and generates a signal which is directed to the microprocessor to commence generation of the signal to drive the transducer driver. A second low battery sensor is used to determine when the battery is depleted to a second predetermined level and generates an output signal which is directed to the transducer driver which then drives the transducer at a lower power consumption rate.

19 Claims, 5 Drawing Figures

REDUCED POWER CONSUMPTION LOW BATTERY ALERT DEVICE

BACKGROUND OF THE INVENTION

1. Field of the Invention

This invention relates to annunciator circuits, and more particularly to a low battery voltage annunciator circuit which reduces the amplitude of the annunciator output signal in order to reduce the power consumption of the annunciator circuit which in turn results in an extension of the time period a low battery alert can be generated.

2. Description of the Prior Art

In the past, especially in paging environments, there has been a need to provide an audible low battery voltage alert to indicate to the user that the battery powering the radio paging device either needs to be recharged or replaced. Such prior art circuits have been designed such that when the battery voltage level has dropped to a predetermined level, the transducer driver amplifier is activated and drives the transducer at a relatively constant amplitude until the user acknowledges the alert by turning off the radio paging device and replacing or recharging the battery.

However, in many instances the user of a paging device is not wearing the radio paging device at the time the battery source is depleted to the predetermined voltage level at which the alert signal is activated. Thus, if the low voltage alert is sounded while the user is away from the radio paging device, the battery source may be rapidly depleted to a level whereby the alert is no longer sounded. Upon return to the location of the paging device, the user would then be unaware that the radio paging device has been rendered inoperative by way of the depleted battery and an important message may be missed.

One such prior art device includes a voltage comparator having its inputs connected to the battery supply voltage and a voltage reference source, respectively. When the battery voltage drops to the level of the reference voltage, the comparator is triggered and generates an output signal. The output signal from the voltage comparator is directed to a microprocessor which, upon sensing the comparator output signal generates a squarewave output signal. The squarewave signal is directed to a transducer driver. The transducer driver is turned on by the squarewave signal and generates an output signal to drive a transducer which generates an audible alert. The audible alert is generated until the pager is turned-off manually or until the battery is depleted to such a low level it cannot supply enough power to drive the transducer.

SUMMARY OF THE INVENTION

Accordingly, one object of the present invention is to provide a novel low battery voltage sensing and annunciator circuit which consumes less power than previous such devices.

Another object of the present invention is to provide a novel low battery voltage sensing and annunciator circuit which enables a low battery voltage alert to be generated for an extended period of time.

It is yet another object of the present invention to provide a novel low battery voltage sensing and annunciator circuit which generates an alert at a first amplitude when the battery voltage is reduced to a first predetermined level and generates an alert at a lower second amplitude when the battery voltage reaches a second predetermined level.

The above and other objects and advantages of the present invention are provided in the preferred embodiment by a first low battery sensor, connected to an input of a microcomputer, for determining when the battery has been depleted to a first predetermined level and generating a first signal indicating that the battery has been depleted to the first predetermined level. The signal is directed to the input of the microcomputer which in response thereto generates a squarewave signal to the input of a transducer driver. The transducer driver then drives the transducer at a first power level. A second low battery sensor is used to determine when the battery has been depleted to a second predetermined level and generates a second signal indicating that the battery has been depleted to the second predetermined level. The second signal is directed to another input of the transducer driver and causes the amplitude of the output signal of the transducer driver to be reduced, resulting in the transducer being driven at a reduced second power level. Further depletion of the battery therefore occurs at a reduced rate.

In a second embodiment, a first low battery sensor is again used to determine when the battery has been depleted to a first predetermined level and generates a first signal which is directed to a microprocessor. However, in this second embodiment, the microprocessor, upon receipt of the first signal in addition to generating a squarewave signal to the input of the transducer driver, starts an internal timer which is programmed to time out after a predetermined number of counts. When the internal timer of the microprocessor times out, the microprocessor generates another signal directed to the other input of the transducer driver which causes the amplitude of the transducer driver output signal to be reduced so that the battery is depleted at a slower rate while the low battery alert is being generated by the transducer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
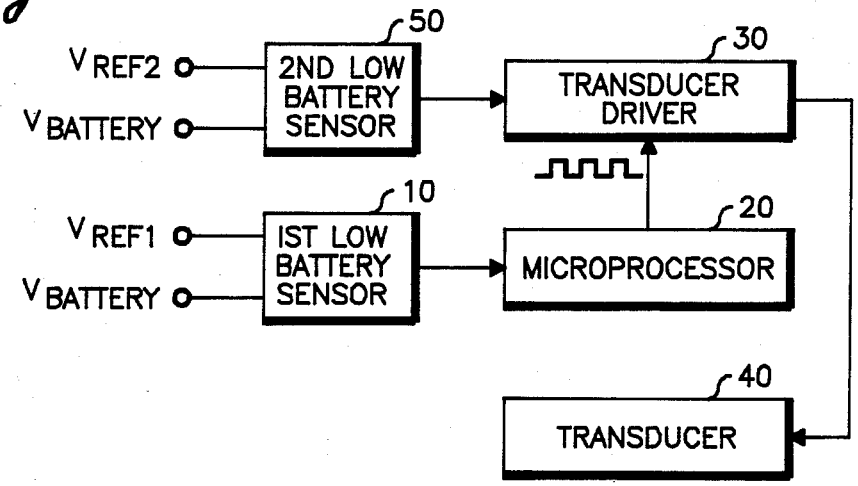
FIG. 1 is a block diagram of one embodiment of the present invention.

Referring now to the drawings, wherein like reference numerals designate identical or corresponding parts throughout the several views, and more particularly to FIG. 1, a block diagram of the first embodiment of the present invention is illustrated. This embodiment of the invention is intended for use in a radio paging device which normally generates an audible alert when the device receives an appropriately addressed selective calling signal. However, it should be realized that any annunciator, including both audio and visual types, may be used to generate an indication that the battery is low. The low battery indicator circuit comprises a first low battery sensor 10 having one input connected to the first voltage reference source which generates the reference voltage $V_{REF1}$, such reference voltage source being well known to those skilled in the art. The other input of the sensor 10 is connected to the battery which generates the battery voltage $V_{BATTERY}$. The first low battery sensor 10 is a comparator circuit of a type well known to those skilled in the art and generates an output signal whenever the divided down battery voltage $V_{BATTERY}$ drops to the reference level $V_{REFl}$. The output of the first low battery sensor 10 is then directed to the input of the microprocessor 20, such as a model number 146805 manufactured by Motorola, Inc. When the active high first signal of the first low battery sensor 10 is received by the appropriate input of the microprocessor 20, the microprocessor 20 generates a square wave output. The squarewave output from the microprocessor 20 is directed to an input of the transducer driver 30 which is used to drive the transducer 40 to provide an audible alert tone. The transducer driver 30 is turned on whenever the microprocessor 20 generates the squarewave signal and drives the transducer at a first predetermined amplitude. The second low battery sensor 50 has one input connected to a second reference voltage source which generates a second reference voltage $V_{REF2}$ and another input connected to the battery source having the voltage level $V_{BATTERY}$. The second low battery sensor is also a voltage comparator well known to those skilled in the art and generates an output signal whenever the divided down battery voltage $V_{BATTERY}$ drops to the $V_{REF2}$ voltage level. The output of the second low battery sensor 50 is directed to another input of the transducer driver 30. The generation of an output signal from the second low battery sensor 50 causes the transducer driver output signal amplitude to be reduced and thus drives the transducer 40 at a lower power level, enabling the battery to be depleted at a slower rate.

In summary, the first low battery sensor determines when the divided down battery voltage drops to a first reference voltage level and generates an output signal indicative thereof. The microprocessor 20 upon receipt of the output signal from the first low battery sensor 10 generates a squarewave signal which is directed to an input of the transducer driver 30. Upon receipt of the squarewave output from the microprocessor, the transducer driver generates an output signal to the transducer 40 at a first amplitude level. When the second low battery sensor 50 determines that the divided down battery voltage has dropped to the level of the second reference voltage $V_{REF2}$, it generates an output signal which is directed to another input of the transducer driver 30. The output signal from the second low battery sensor 50 causes the amplitude of the output signal of the transducer driver 30 to be reduced, decreasing the volume of the audible signal emitted by the transducer 40 and thus depleting the battery at a slower rate than normal.

Figure 2:
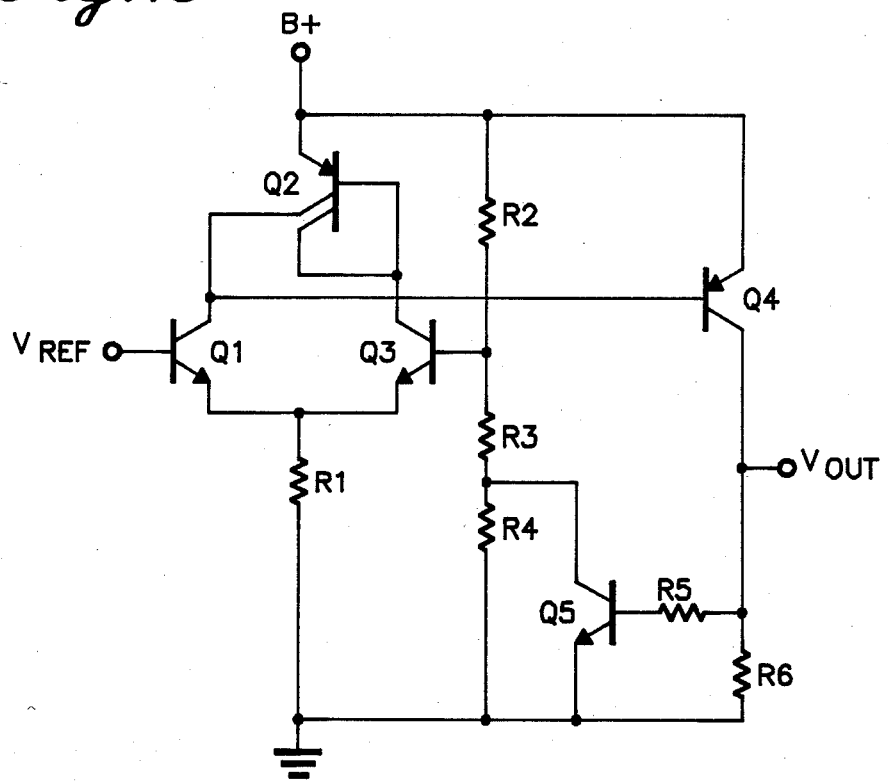
FIG. 2 is a schematic diagram of the first and second low battery sensors of FIG. 1.

Referring now to FIG. 2 a schematic diagram of the preferred comparator circuit to be used as the first low battery sensor 10 and the second low battery sensor 50 is illustrated. The comparator includes a transistor Q1 having its base connected to the voltage reference source and its emitter connected to ground through the resistor R1 which in the preferred embodiment has a value of 74 kilo-ohms. The transistor Q2 has its emitter connected to the battery supply voltage B+and one of its collectors connected to the collector of the transistor Q1. The transistor Q3 has its emitter connected to ground through the resistor R1 and its collector connected to the base and second collector of the transistor Q2. The base of transistor Q3 is connected to the node between divider resistors R2 and R3. The resistor R2 has its other end connected to the emitter of the transistor Q4 and the battery supply voltage B+, while the other end of the resistor R3 is connected to the node between one end of another divider resistor R4 and the collector of the transistor Q5. The other end of the divider resistor R4 is connected to ground. The base of the transistor Q4 is connected to the collector of transistor Q1, while the base of the transistor Q5 is connected to one end of the resistor R5. The other end of the resistor R5 is connected to the node connecting the collector of the transistor Q4 to one end of resistor R6. The other end of the resistor R6 is to ground. The emitter of the transistor Q5 is also connected to ground. The values for the resistors R2 through R6 for the comparator when being used as the first low battery sensor 10 are 47 kilo-ohms, 130 kilo-ohms, 10, kilo-ohms, 50 kilo-ohms, and 100 kilo-ohms, respectively. The value of the voltage reference input for the first low battery sensor 10 is 0.825 volts and the threshold battery voltage B+ to trigger the comparator is 1.1 volts.

It should be noted that the voltage comparator of FIG. 2 is also used as the second low battery sensor 50, except that the resistor values R1 through R6 have been changed to 74 kilo-ohms, 30 kilo-ohms, 130 kilo-ohms, 10 kilo-ohms, 50 kilo-ohms, 100 kilo- z2 ohms, respectively; the reference voltage $V_{REF}$is 0.825 volts, and the threshold voltage of the battery supply voltage B+ to trigger the second battery sensor 50 is 1.00 volts.

When used as the first battery sensor, the voltage comparator of FIG. 2 operates as follows. The voltage divide formed by resistors R2, R3 and R4 divides down the battery voltage by a factor of:

$$\text{DIVIDER RATIO}=(R3+R4)/(R2+R3+4)=0.825/1.10=0.75$$

With this value of divider ratio, and a reference voltage of 0.825 volts, the differtial comparator stage formed by transistors Q1, Q2 and Q3 keeps transistor Q4 in an OFF or non-conducting state for values of battery voltage above 1.10 volts.

When the supply voltage drops to 1.10 volts or less, the differential comparator switches ON transistor Q4, which in turn generates an output voltage designated as $V_{OUT}$. When the transistor Q4 is turned on it also turns on the transistor Q5 which shorts out the resistor R4 of the voltage divider resistor combination of R2, R3 and R4. This is done to prevent the comparator from "chattering" ON/OFF once the battery supply voltage drops to the $V_{REF}$level. More simply, the transistor Q5 is used to provide a hysterisis for the comparator so that the voltage will have to rise higher than the voltage that triggers the comparator to turn off again which more practically prevents the comparator from chattering. The other comparator operates in a similar manner but with different divider resistor values, when used as the second low battery sensor.

Figure 3:
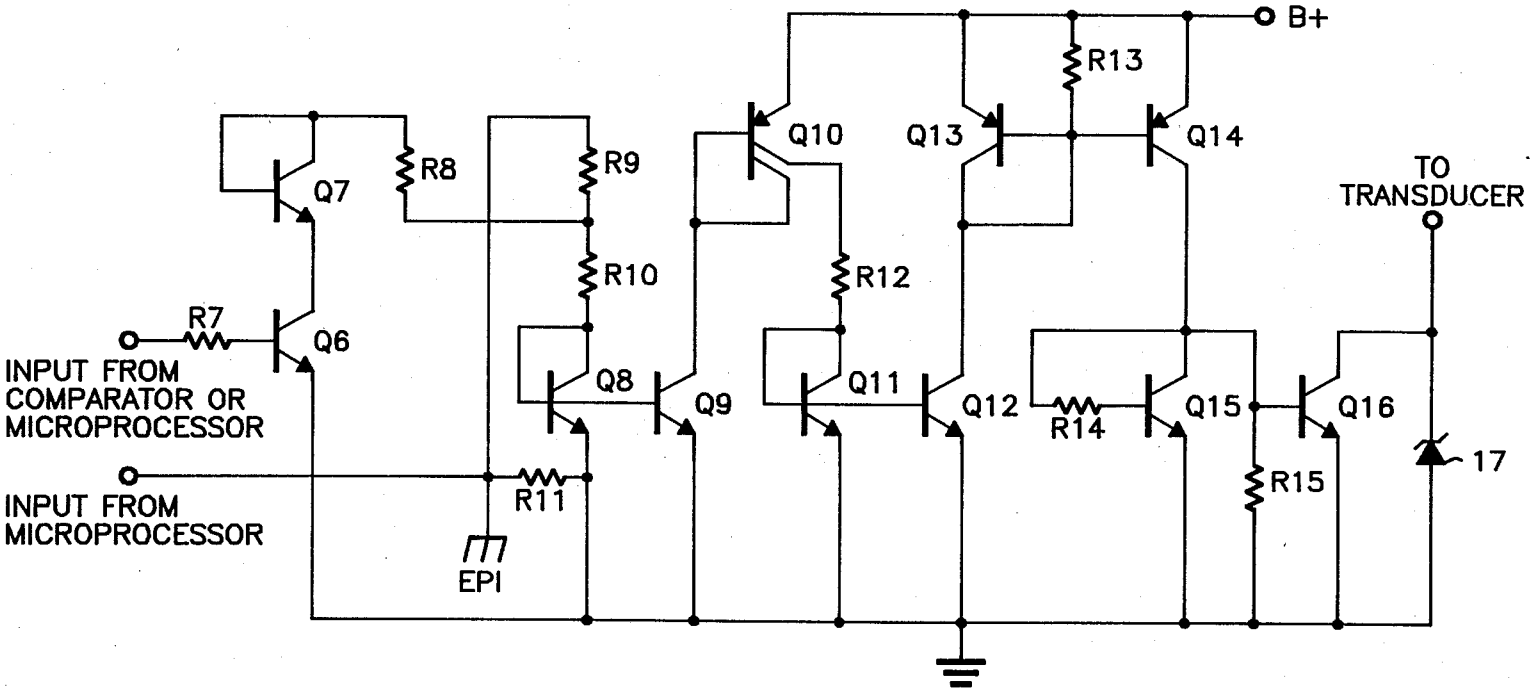
FIG. 3 is a schematic diagram of the transducer driver of FIG. 1.

Referring now to FIG. 3, a schematic diagram of the transducer driver circuit 30 is illustrated. The base of the transistor Q6 is connected through the resistor R7 to the $V_{OUT}$ terminal of the comparator circuit illustrated in FIG. 2. The emitter of the transistor Q6 is connected to ground. The collector of the transistor Q6 is connected to the diode Q7 while the other end of the diode Q7 is connected to one end of the resistor R8. The other end of the resistor R8 is connected to the junction of the resistors R9 and R10. The other input of the transducer driver circuit is connected to the output of the microprocessor which generates a squarewave signal when the battery voltage drops to the first threshold voltage level. This other transducer driver input is connected to the transistor Q8 through the resistors R9 and R10. The input from the microprocessor is also connected to ground through the resistor R11. The transistor Q8 has its base and collector connected to one end of the resistor R10 and its emitter connected to ground. The base of the transistor Q9 is connected to the base of the transistor Q8 while its emitter is connected to ground. The collector of the transistor Q9 is connected to the base and one collector of the transistor Q10. The emitter of the transistor Q10 is connected to the battery supply voltage B+while its other collector is connected to the base and collector of the transistor Q11 through the resistor R12. The emitter of the transistor Q11 is connected to ground while its base and collector are also connected to the base of the transistor Q12. The emitter of transistor Q12 is connected to ground while the collector of transistor Q12 is connected to the collector and base of transistor Q13. The emitter of transistor Q13 is connected to the battery supply voltage B+while its base is connected to the base of the transistor Q14. The resistor R13 is connected between the battery supply voltage B+and the bases of transistors Q13 and Q14. The collector of the transistor Q14 is connected to the collector of the transistor Q15. The base of the transistor Q15 is connected through the resistor R14 to the collectors of transistors Q14 and Q15. The base of the transistor Q16 is connected to the collectors of transistors Q14 and Q15 and to one end of the resistor R15 which has its other end connected to ground. The collector of the transistor Q16 is connected to the positive or anode terminal of Zener diode 17 this node also representing the output to the transducer 40. The emitter of transistor Q16 is connected to ground. The negative or cathone terminal of Zener diode 17 is also connected to ground.

The transducer driver 30 normally is off until a squarewave voltage waveform is received from the microprocessor 20. When the squarewave signal is received, the transducer driver is switched ON and OFF by the signal. The high level of the input signal applies a current through the resistors R9 and R10 to the diode Q8. The current mirror formed by Q8 and Q9 generates an amplified signal that passes through each stage of the amplifier stages comprised of the transistors Q10 through Q17 and its further amplified through each stage until a current wave form is finally applied to the transducer 40. It should be remembered that the first low battery sensor 10 generates a signal to start the microprocessor's generation of a squarewave signal when the battery voltage drops to a first threshold voltage level, in this case 1.1 volts. When the battery voltage drops to the second threshold value of 1.0 volts, the second low battery sensor 50 is triggered and generates a signal which is received at the other input to the transducer driver circuit at one end of the resistor R7. The output signal from the comparator applies a current through R7 to the base of transistor Q6. This in turn causes the transistor Q6 to turn on and provide a shunt path to ground in the input current network of the transducer driver. In particular, a large portion of the current being generated by the microprocessor is diverted from the junction of the resistors R9 and R10 to ground through the resistor R8, the diode Q7 and the transistor Q6. This substantially lowers the input current that is applied to the input of the amplifier, reduces the value of the output current applied to the transducer and significantly reduces the power consumed by the transducer driver. It should be noted that the diode Q7 is a bias equalization element, such that when the device is in the reduced output mode, the voltage across the diode Q8 is matched by the voltage across diode Q7 to provide for a well defined current division ratio in the input current attenuator formed by R8, R9 and R10.

It should be further understood that when there is no output from the second low battery sensor 50, the amplifier portion of the transducer driver acts like a current mirror through the transistors Q8 through Q14. More precisely, by using current mirroring techniques that are well known in the integrated circuit design art, the collector current of the transistor Q9 is twice the current that went into the diode Q8, the diode current going into Q11 is three times the base current of the transistor Q10. The collector current of Q12 is 10 times the current that flows into the diode Q11 and the collector current of the transistor Q14 is 8 times the current that flows into the diode Q13. However, keeping in mind that there is no input from the comparator to reduce the amplitude of the signal from the microprocessor, there is enough current generated by the transistor Q14 so that the resistor R14 prevents the combination formed by transistors Q15 and Q16 from acting like a current mirror circuit. Instead, in this state, almost all of the collector current of the transistor Q14 flows into the base of the transistor Q16. This causes the transistor Q16 to act like a switch rather than a current mirror, with the result that Q16 is driven ON and OFF in a manner that drives the transducer with a minimum of power dissipation in Q16. So in the instance when the full output signal from the microprocessor flows through the amplifier stages of the transducer driver, the transducer output transistor Q16 functions as a switch and applies the full supply voltage across the transducer. Zener diode 17 functions to limit any flyback voltage excursion that may be generated by switching the transducer ON and OFF in this manner.

More specifically, for the high output mode of the amplifier shown in FIG. 3, the microcomputer applies an input current of 15 microamperes to diode Q8 through the series combination of R8 and R9. This current is amplified or mirrored to 30 microamperes by transistor Q9 which is matched to Q8 but is 2 times larger in function size. The output current of Q9 is further amplified to 90 microamperes by transistor Q10, which is configured as a current mirror with a gain factor of 3 and to 900 microamperes by rationed by transistors Q11 and Q12.

Thirty microamperes of the current from Q12 flows through resistor R13, and the remaining 870 microamperes is amplified to a level of 6.9 milliamperes by transistors Q13 and Q14. The purpose of R13 is to provide a shunt leakage path to insure that small leakage currents do not generate an output current when the amplifier is in the OFF state. Finally, 100 microamperes of the current from Q12 flows to ground through resistor R15, approximately 2 milliamperes flow through transistor Q15, and the remaining 4.7 milliamperes flows into the base of transistor Q16. This latter base current for Q16 enables this device to efficiently switch output currents of up to 200 milliamperes for nominal circuit values.

On the other hand, when the control signal from the second comparator is received, transistor Q6 is switched ON and most of the input current from the microprocessor that flows through resistor R9 is directed to ground through resistor R8 and diode Q7. The result is that a greatly reduced level of current flows through R10 and into the input of the transducer driver amplifier. In one embodiment of the invention, resistors R8, R9 and R10 have values of 7 kilo-ohms, 80 kilo-ohms, and 80 kilo-ohms respectively. For these resistor values, and a microprocessor supply voltage of 3.0 volts, the microprocessor applies an input current of 15 microamperes to the amplifier input through the series combination of R8 and R9 when the volume control signal from the comparator is in the low or full output state. The input current to the amplifer is diminished to 2.2 microamperes when the volume control signal from the comparator is switched to the active or low output state.

In the low volume state, the input current into diode Q8 is amplified by the current mirror stages that form the transducer amplifier in much the same way that the input current is amplified in the high volume state, with one major exception. This exception is that in the reduced output mode, the circuit configuration composed of the combination of R14, Q15 and Q16 functions as a current mirror in which the output collector current of transistor Q16 accurately ratios the collector current of transistor Q15 wherein in the high output state, comparatively little of the current from transistor Q14 flows through Q15 and the output stage functions as an efficient power switch in which the saturation voltage of transistor Q16 is minimized.

Specifically, in the low current mode, a current of 2.2 microamperes flows into diode Q8. This current is mirrored by device Q9, which has a collector current of approximately 4.4 microamperes. This current from Q9 is further amplified by PNP transistor Q10 to approximately 17.6 microamperes.

The output current from Q10 is further amplified by the current mirror formed by transistors Q11 and Q12, which have an area ratio of ten. Thus the output collector current of this stage is approximately 176 microamperes.

The output current from Q12 is then applied to the current mirror formed by Q13 and Q14, which also have a resistor R13 with a value of 20 kilo-ohms connector across their emitter-base junction. Of the 176 microamperes supplied to this stage, approximately 30 microamperes flow through R13, and 146 microamperes flow into diode Q13. Transistor Q14 is matched to transistor Q13 with an area difference of 8 times, so that the output current of Q14 is approximately 1.2 millamperes.

This current is applied to the next stage that is composed of transistors Q16 and Q17, and resistors R14 and R15. R15 functions as a leakage path and insures small leakeage current will not activate or turn ON the output transistor Q16.

Transistors Q15 and Q16 and resistor R14 form a modified current mirror circuit in which the ratio of the output collector current of Q16 to the input collector current of Q15 is a function of the absolute level of the input current. Thus, at high input current levels, the base curent of transistor Q15 develops a rather large voltage across resistor R14, with the result that transistor Q16 has a significantly higher base to emitter voltage than transistor Q15. As a direct consequence, transistor Q16 has a significantly higher junction current density than transistor Q15, and the net result is that in at high input current levels, comparatively little of the input current flows into transistor Q15 and the majority of the current flow into the base of Q16. This mode of operation optimizes the switching characteristics of transistor Q16 and provides for efficient operation of the amplifier in the full volume output mode.

For lower values of input current from transistor Q14, the modified current mirror circuit formed by Q15, Q16 and R14 functions as a current mirror that establishes a fixed value of output collector current for transistor Q16.

Specifically, of the 1.2 milliamperes that appears at the collector of Q14 in the low volume mode, approximately 100 microamperes flows through resistor R15 to ground. For a nominal transistor beta of 100, and a device area ratio of Q16 to Q15 of 24, approximately 240 microamperes flows into the base of Q16, and 860 microamperes flows into the collector of Q15. Thus, the base current of Q15 is 8.6 microamperes, and the voltage drop across R14 is 8.6 millivolts. These voltage and current levels agree with the well known theory that describes the current and voltage relationship of bipolar transistors, and the same theory can be used to modify the current levels at which the output stage operates.

Thus, in the low volume output mode, the output signal applied to the transducer by transistor Q16 switches from the voltage drive conditions that are used in the full output mode, to a current drive mode in which a square wave of current is applied. In the embodiment shown, this current waveform has a peak value of approximately 30 milliamperes.

Figure 4:
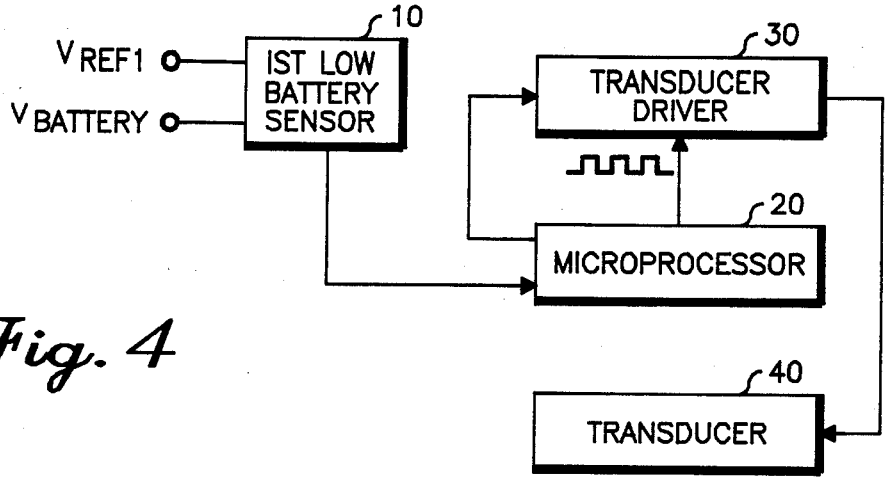
FIG. 4 is a block diagram of another embodiment of the present invention.
Figure 5:
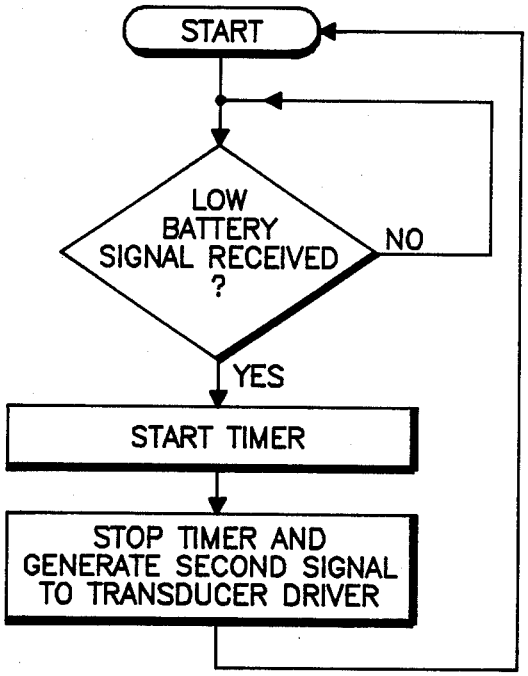
FIG. 5 is a flow chart for the operation of the internal timer of the microprocessor of FIG. 4.

Referring now to FIG. 4, another embodiment of the present invention is illustrated in block diagram form. In this embodiment, the first low battery sensor 10 generates an output signal when the battery voltage drops to the level of the first reference voltage $V_{REF1}$. Upon receipt of the output signal from the first low battery sensor 10, the microprocessor 20 in addition to generating a square-wave signal to energize the transducer driver 30, starts an internal timer to time out a predetermined time period. Once the internal timer of the microprocessor's 20 times out, the microprocessor generates another signal to the input network of the transducer driver 30 which turns on the transistor Q6 as shown in FIG. 3. The transducer 40 is then driven by the transducer driver 30 at a lower power level. The flow chart for the internal timer of the microprocessor is illustrated in FIG. 5.

Obviously (numerous additional) modifications and variations of the present invention are possible in light of the above teachings. It is therefore to be understood that within the scope of the appended claims, the invention may be practiced otherwise as specifically described herein.

What is claimed as new and desired to be secured by Letters Patent of the United States is:

1. A depleted battery indicator for a device being powered by a battery, said battery indicator comprising:

audio annunciator means for providing an audible alert;

circuit means, connected to said annunciator means, for determining when said battery has been depleted to a first predetermined voltage and generating a first signal to activate said annunciator means whereby said alert is provided at a first power level and for determining when said battery has been depleted to a second predetermined voltage and generating a second signal to further activate said annunciator means whereby said alert is provided at a second power level wherein said second power level is less than said first power level, thereby prolonging battery life.

2. The device, according to claim 1, wherein said circuit means comprising:

comparator means, for generating said first signal whenever the battery voltage decreases to said first predetermined voltage.

3. The device, according to claim 1, wherein said circuit means comprising:

comparator means, for generating said second signal whenever the battery voltage decreases to said second predetermined voltage.

4. The device, according to claim 1, wherein said circuit means further comprising:

processor means for generating a signal to turn on said annunciator means; and first voltage comparator means, connected to said processor means, for generating said first signal whenever the battery voltage decreases to said first predetermined voltage whereby said annunciator means turn on signal is generated by said processor means and said alert is provided at said first power level.

5. The device, according to claim 4, wherein said circuit means further comprises:

second voltage comparator means, connected to said annunciator means, for generating said second signal whenever the battery voltage decreases to said second predetermined voltage whereby said alert is provided at said second power level.

6. A depleted battery indicator for a device being powered by a battery, said battery indicator comprising:

a transducer, for generating an audible alert;

transducer driver means, connected to said transducer, for driving said transducer;

processor means, connected to said transducer driver means, for generating a turn-on signal to activate said transducer driver means whereby said transducer generates said audible alert;

first voltage comparator means, connected to said processor means, for generating a first signal whenever the battery voltage decreases to a first threshold voltage whereby said turn-on signal is generated by said processor means and causes said transducer to be driven at a first power level;

second voltage comparator means, connected to said transducer driver means, for generating a second signal whenever the battery voltage decreases to a second threshold voltage which causes said transducer to be driven at a second power level wherein said second power level is less than said first power level, thereby prolonging battery life.

7. A depleted battery indicator for a device being powered by a battery, said battery indicator comprising:

audio annunciator means for providing an audible alert;

circuit means, connected to said annunciator means, for determining when said battery has been depleted to a predetermined voltage and generating a first signal which causes said annunciator means to provide said alert at a first power level and for generating a second signal at a predetermined time after said first signal is generated which causes said annunciator means to provide said alert at a second power level wherein said second power level is less than said first power level, thereby prolonging battery life.

8. The device, according to claim 7, wherein said circuit means comprising:

voltage comparator means for generating said first signal whenever said battery is depleted to said predetermined voltage.

9. The device, according to claim 7, wherein said circuit means comprising:

processor means, connected to said annunciator means, for generating a turn-on signal to activate said annunciator means whenever said first signal is generated and for generating said second signal at said predetermined time after said first signal is generated.

10. The device, according to claim 8, wherein said circuit means further comprising:

processor means, connected to said comparator means and said annunciator means, for generating said turn-on signal to activate said annunciator means whenever said first signal is generated and for generating said second signal at said predetermined time after said first signal is generated.

11. The device, according to claim 9, wherein said processor means comprising:

timer means for counting said predetermined time after said first signal is generated.

12. The device, according to claim 10, wherein said processor means comprising:

timer means for counting said predetermined time after said first signal is generated.

13. A depleted battery indicator for a device being powered by a battery, said battery indicator comprising:

a transducer for generating an audible alert;

transducer driver means, connected to said transducer, for driving said transducer;

voltage comparator means, connected to said battery, for comparing the battery voltage to a reference voltage and generating a first signal whenever said battery voltage decreases to a threshold voltage;

processor means, connected to said transducer driver means and said comparator means, for generating a turn-on signal to activate said transducer driver means whenever said first signal is generated which causes said transducer to be driven at a first power level, said processor means including a timer means for timing a predetermined time period after said first signal is generated, said processor means for generating a second signal to said transducer driver means after said predetermined time period which causes said transducer to be driven at a second power level wherein said second power level is less than said first power level, thereby prolonging battery life.

14. A method of indicating a depleted battery in a device being powered by a battery and having an audio annunciator means for generating an audible alert, comprising the steps of:

determining when said battery has been depleted to a first predetermined voltage;

activating said annunciator means to generate said alert at a first power level;

determining when said battery has been depleted to a second predetermined voltage;

further activating said annunciator means to generate said alert at a second power level wherein said second power level is less than said first level, thereby prolonging battery life.

15. The method, according to claim 14, wherein said step of determining when said battery is depleted to a first predetermined voltage comprises the step of:

comparing the battery voltage to a reference voltage and generating a signal which indicates that said battery voltage has decreased to said first predetermined voltage.

16. The method, according to claim 14, wherein said step of determining when said battery is depleted to a second predetermined voltage comprises the step of:

comparing the battery voltage to a reference voltage and generating a signal which indicates that said battery voltage has decreased to said second predetermined voltage.

17. A method of indicating a depleted battery in a device being powered by a battery and having an audio annunciator means for generating an audible alert, comprising the steps of:

determining when said battery has been depleted to a predetermined voltage;

activating said annunciator means to generate said alert at a first power level;

further activating said annunciator means to generate said alert at a second power level a predetermined time after said battery has been depleted to said predetermined voltage wherein said second power level is less than said first power level, thereby prolonging battery life.

18. The method, according to claim 17, wherein said step of determining when said battery is depleted to a predetermined voltage comprises the step of:

comparing the battery voltage to a reference voltage and generating a signal which indicates that said battery voltage has decreased to said predetermined voltage.

19. The method, according to claim 17, wherein said step of activating said annunciator means to generate said alert at a first power level comprises the step of:

starting a timing means which generates a signal after said predetermined time period has elapsed.

* * * * *